United States Patent [19]

Van Eyk

[11] 3,950,908

[45] Apr. 20, 1976

[54] FLOOR OR WALL COVERING PANEL

[75] Inventor: Johannes Felix Etienne Van Eyk, Tegelen, Netherlands

[73] Assignee: B.V. Betonfabriek Het Zuiden, Tegelen, Netherlands

[22] Filed: Apr. 8, 1974

[21] Appl. No.: 459,231

[30] Foreign Application Priority Data

Apr. 10, 1973 Germany ..... 7313497[U]
June 9, 1973 Germany ..... 2329542

[52] U.S. Cl. ..... 52/436; 52/598; 404/33; 404/44

[51] Int. Cl.[2] ..... E04F 13/08; E04C 02/80

[58] Field of Search ..... 52/424, 429, 430, 508, 52/598, 599, 603, 436; 404/33, 44, 34

[56] References Cited

UNITED STATES PATENTS

| | | | |
|---|---|---|---|
| 624,523 | 5/1899 | Myers | 52/598 |
| 1,017,067 | 2/1912 | White | 52/436 |
| 1,644,035 | 10/1927 | Rocic | 52/436 |
| 2,181,814 | 11/1939 | Knapp | 52/603 |
| 2,370,638 | 3/1945 | Crowe | 52/598 |
| 3,827,818 | 8/1974 | Ruyters | 404/44 |

FOREIGN PATENTS OR APPLICATIONS

| | | | |
|---|---|---|---|
| 514,047 | 11/1971 | Switzerland | 52/599 |

*Primary Examiner*—J. Karl Bell
*Attorney, Agent, or Firm*—Toren, McGeady and Stanger

[57] ABSTRACT

A safety panel assembly for covering the walls or floors of areas such as playgrounds and the like is formed with a rigid planar carrier element having a spaced resilient covering element mounted thereto. The carrier element has recesses into which mounting projections integrally formed on the covering element extend. A hardened binder material locks the mounting projections in place and a plurality of spacer elements or ribs abut the rigid carrier element to provide hollow spacing between the elements and to insure a cover panel assembly exhibiting sufficient resiliency upon impact.

4 Claims, 4 Drawing Figures

FLOOR OR WALL COVERING PANEL

The invention relates to a floor or wall covering panel comprising a carrier made from stone, concrete, ceramic material or some other rigid material and a coating element of elastic meterial such as rubber or plastics.

For children's playgrounds, sports grounds or tennis course or the like, it is frequently necessary for the ground surface to be resistant to weather, to be stable and maintenance-free and yet resilient or elastic in order to alleviate the hardness of impact in the case of players or other persons.

The object of the invention is so to construct floor or wall covering panels for children's playgrounds, sports areas or the like, that a weather resistant resiliently elastic floor surface is produced which can be subjected to loading for a prolonged period and which can be laid just as firmly as the normal stone, concrete or metal panels of hitherto conventional type.

The floor or wall covering panels according to the invention, which consist of a rigid carrier element and secured on the upper face thereof, a coating element of elastic material are characterised in that the coating element comprises integral back-sloping projections which project into recesses in the carrier element and which are secured therein by means of a hardened binder which virtually fills the recesses.

As mentioned above, the carrier element may consist of any conventional rigid material hitherto used for floor or wall covering panels such as particularly concrete, but also stone, ceramic material, rigid plastics material, synthetic stone material or the like. These carrier elements are heavy and lie possibly joint to joint with other elements firmly on the underlying surface. The covering element on the other hand consists of an elastic material such as rubber or resilient plastics material, and thus has a high damping value by which it substantially improves safety, for example in the case of sports areas.

The binder which secures the back-cut projections of the covering element may be any inorganic or organic hardening binder such as for example cement, hardening cement compositions or hardening synthetic plastics compositions. These binders are filled into the preformed recesses in the carrier element in the non-hardened state, whereupon the back-cut projections on the covering element are pressed sufficiently into the binder that the covering element is resting on the carrier element, the still soft binder flowing into the back-cut portions of the projections. Thereupon, the binder is left to harden after which the carrier element and the covering element are rigidly connected to each other.

Increased elasticity can be obtained in the covering element if this latter consists of a cover panel with spacers mounted thereon, the free ends of the spacers resting on the carrier element so that air filled cavities are enclosed between them. It is expedient for the covering element, including the back-cut projections and the spacers and possibly an encircling edge of the same height as the spacers to be produced in one piece which can easily be achieved if rubber material or elastic plastics material is used and moulded in an appropriate press.

The spacers may for example take the form of studs or ribs, although they may have any desired shape. Preferably, the spacers consist of a multiplicity of studs of ideally cylindrical or frustoconical form, in the latter case favourably tapering towards the carrier element.

The air space enclosed by the cover plate, the carrier element, the spacers and, where applicable, the encircling rim, enhances the elasticity of the panel covering, so that this yields resiliently to any impacts from the surface. If the edges of the rim of the covering element are flush with the two walls of the carrier element, panels are obtained into which no form of precipitation can penetrate, so increasing resistance to weather. The back-cut projections are expediently provided at least in the region of each corner of the covering element so that appropriate recesses must also be provided in the regions of the carrier element. Naturally, however, it is possible also to provide still further back-cut projections between the areas of the corners. The flexural and connecting rigidity of the conventional rubber materials makes it possible however largely to reduce the number of such back-cut projections without the covering element being able to become detached from the carrier element in the same way as a concrete panel.

By virtue of the back-cut shape of the projections, these latter become firmly anchored in the recesses in the carrier element and cannot be pulled out arbitrarily. If the edges of the free ends of the back-cut projections which may possibly take the form of a plate of a larger diameter than the other parts of the projections, are rounded off or angles off, insertion of the back-cut projections into the recesses in the carrier element or into the not yet hardened binder introduced into those recesses during manufacture of the floor or wall covering panels according to the invention will be facilitated.

Figure 1:
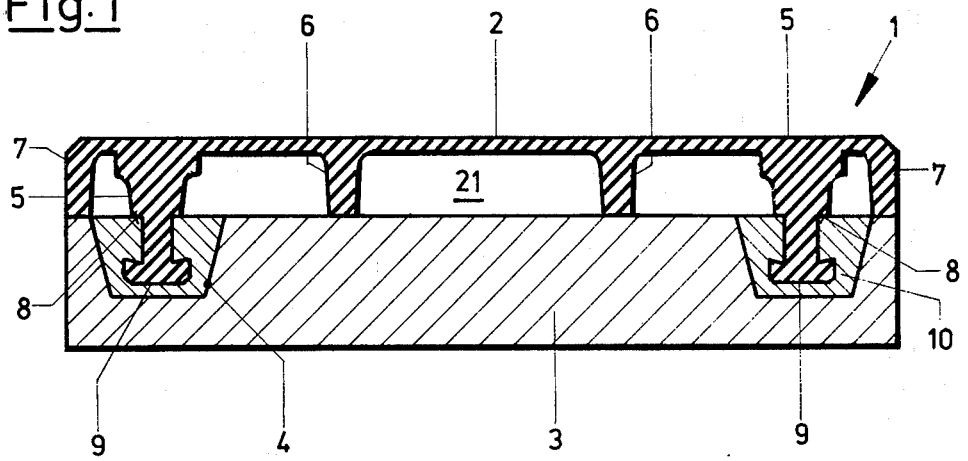
FIG. 1 shows a cross-section through a floor or wall covering panel according to the invention taken on the line A—A in FIG. 2.
Figure 2:
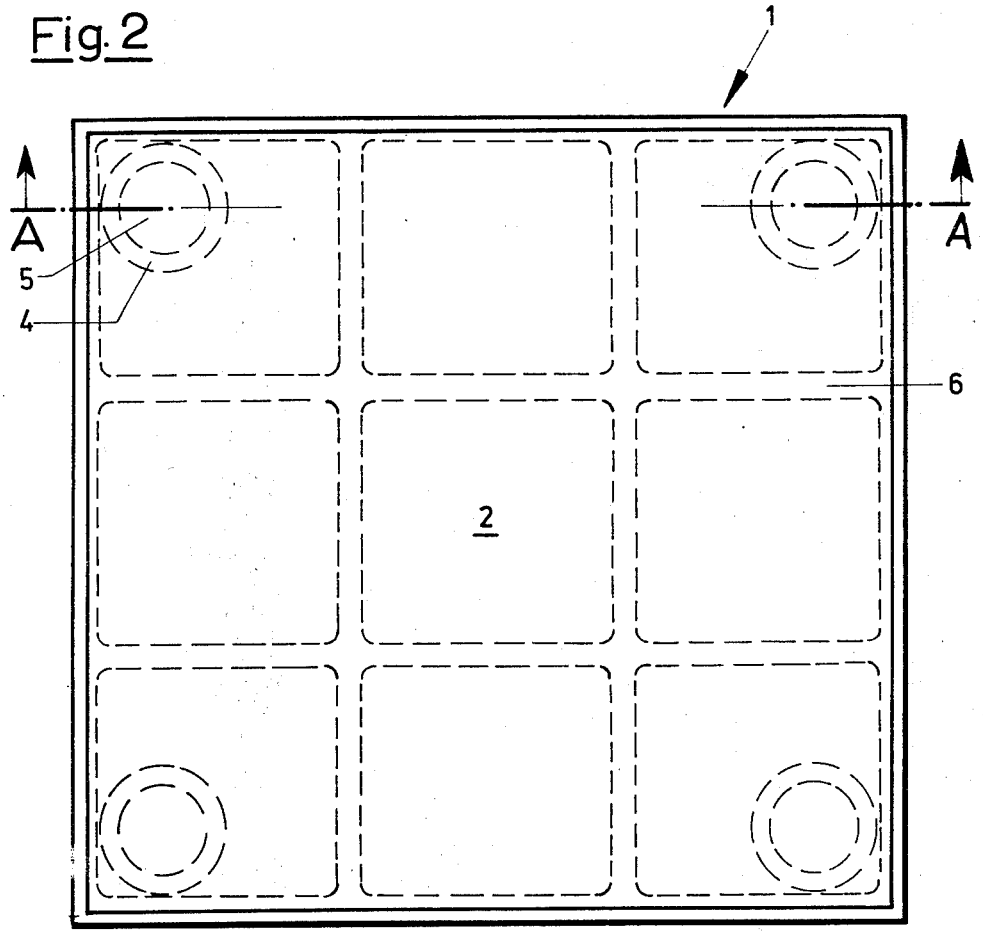
FIG. 2 is a plan view of the floor or wall covering panel according to the invention which is shown in FIG. 1.

By cutting the floor or wall covering panel according to the invention along the line A—A in FIG. 2, the section shown in FIG. 1 can be obtained. While FIG. 2 shows only the covering element 1 or the cover wall 2 thereof, details can be seen more satisfactorily from the cross-section in FIG. 1. The carrier element 3 forms the support for the covering element 1. Into the recesses 4 shown in FIG. 2 by broken circles and filled with a hardened binder 10 project the back-cut projections 5 which in the region of the four corners of the cover panel 2 project rearwardly and downwardly from the rear face thereof. Bracing ribs 6 extend parallel with the edges 7 of the covering element 1 at a distance from the projections 5.

Looking towards the free end, the projections 5 first have a thicker fixing and bracing member, of which the free shoulders 8 rest on the surface of the concrete carrier element 3, then a stem and on the free end of this latter a retaining disc or thickened portion 9.

The edges 7 of the covering element 1 are flush with the side walls of the carrier element 3. Consequently, hardly any form of precipitation can penetrate the outer spaces between the upper face of the carrier element 3 and the underside of the cover panel 2, so that the inner cavities, of which one is identified by reference numeral 21, can be regarded substantially as free from condensation. The high damping value of the floor or wall covering panel according to the invention is provided by using rubber as the covering element 1.

Figure 3:
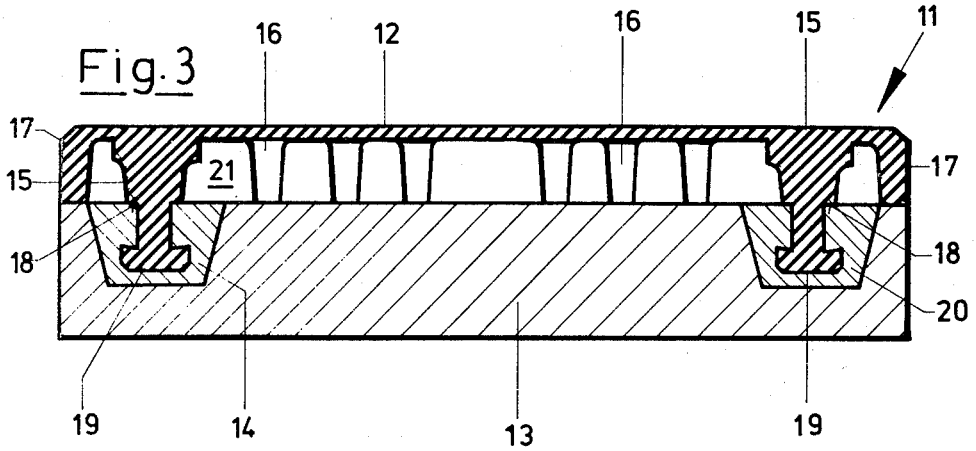
FIG. 3 is a cross-section through another embodiment of floor or wall covering panel according to the invention taken on the line B—B in FIG. 4.
Figure 4:
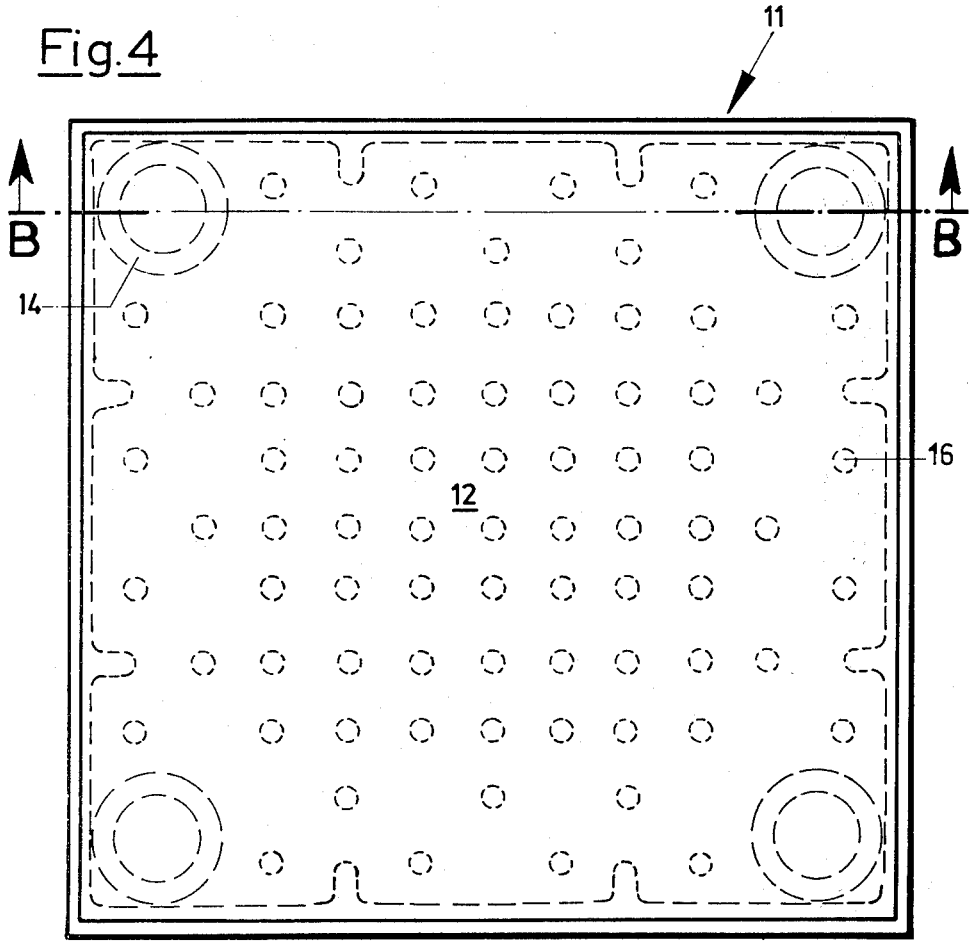
FIG. 4 is a plan view of the floor or wall covering panel according to the invention, as shown in FIG. 3.

The further embodiment of a floor or wall covering panel according to the invention, as shown in FIGS. 3 and 4, differs from the embodiment shown in FIGS. 1 and 2 only by virtue of the different construction of the spacers 16 which in this case take the shape of frusto-conical studs, the free ends of which rest on the carrier element 13. The greater number of studs 16, here provided at shorter intervals from one another, provdes increased resistance of the covering element to deformation under continuous loading.

For the rest, FIGS. 3 and 4 show the entire covering element 11 which consists of the cover panel 12, the back-cut projections 15 with their supporting shoulders 18 and thickened portions 19, the stud-like spacers 16 and the encircling rim 17. The recesses in the carrier element 13 are identified by reference numeral 14 while 20 denotes the binder filled into these recesses. One of the cavities between the stud-shaped spacers 16 is shown at 21 in FIG. 3.

I claim:

1. A panel assembly particularly suitable as covering for the surfaces of playgrounds or other similar areas, comprising:

a carrier element consisting essentially of rigid material and having a generally planar configuration;

means defining a plurality of spaced recesses formed as receptacles opening on one side only of said carrier element;

a covering element formed as a unitary integral body consisting essentially of resilient material and having a generally planar configuration substantially congruent with said carrier element, said covering element comprising:

a generally planar cover wall, a plurality of mounting projections extending integrally from said cover wall, and substantially perpendicularly thereto and having back-cut portions, the number of said recesses provided being at least as many as the number of said projections and coincident therewith, a plurality of spacer elements extending integrally from said cover wall substantially perpendicularly therefrom on the same side thereof as said mounting projections; and a rim extending completely about the periphery of said covering element generally perpendicularly therefrom terminating into abutting relationship with said carrier element against said one side thereof about the entire periphery of said panel assembly;

said recesses being dimensioned to receive therein said mounting projections to an extent at least including said back-cut portions; and hardened binder material filling said recesses in said carrier element;

said carrier element and said covering element being affixed together in a spaced apart relationship by said binder material with said mounting projections extending into said recesses and imbedded in said binder material and with said spacer elements abutting directly against said carrier element in contact therewith to define hollow spaces between said carrier element and said cover wall of said covering element.

2. An assembly according to claim 1 wherein said spacer elements comprise a plurality of longitudinal transversely extending ribs.

3. An assembly according to claim 1 wherein said spacer elements comprise a plurality of frusto-conical studs having a tapering configuration narrowing toward said carrier element.

4. An assembly according to claim 1 wherein said mounting projections comprise shoulder portions formed at the point of engagement between said hardened binder material and said mounting projections and extending in abutting relationship with the surface of said hardened binder material.

* * * * *